US008807274B2

(12) United States Patent
Müller et al.

(10) Patent No.: US 8,807,274 B2
(45) Date of Patent: Aug. 19, 2014

(54) CONTROL DEVICE OF A MOTOR VEHICLE

(75) Inventors: Bernd Müller, Wiernsheim (DE); Jürgen Schorn, Rutesheim (DE); Michael Reinhardt, Heilbronn (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 13/539,743

(22) Filed: Jul. 2, 2012

(65) Prior Publication Data

US 2013/0008737 A1 Jan. 10, 2013

(30) Foreign Application Priority Data

Jul. 8, 2011 (DE) ..... 10 2011 051 690

(51) Int. Cl.

| | |
|---|---|
| ***F01N 1/02*** | (2006.01) |
| ***F02M 35/12*** | (2006.01) |
| *F01N 1/00* | (2006.01) |
| *F02M 35/00* | (2006.01) |

(52) U.S. Cl.

USPC ..... 181/254; 181/250; 123/184.57

(58) Field of Classification Search

USPC ..... 181/229, 250, 254, 251, 268, 272, 275; 123/184.53, 184.57; 60/312, 322, 324

See application file for complete search history.

(56) References Cited

U.S. PATENT DOCUMENTS

| | | | | |
|---|---|---|---|---|
| 5,957,102 | A * | 9/1999 | Schorn | 123/184.57 |
| 6,105,546 | A * | 8/2000 | Fuesser et al. | 123/184.57 |
| 6,600,408 | B1 * | 7/2003 | Walter et al. | 340/384.1 |
| 6,633,646 | B1 | 10/2003 | Hwang | |
| 6,644,436 | B2 * | 11/2003 | Hofmann et al. | 181/214 |
| 6,732,510 | B2 * | 5/2004 | Ciray | 60/312 |
| 6,848,410 | B2 * | 2/2005 | Hoffmann et al. | 123/184.57 |
| 6,938,729 | B2 * | 9/2005 | Worner et al. | 181/254 |
| 7,353,791 | B2 * | 4/2008 | Sasaki et al. | 123/184.57 |

(Continued)

FOREIGN PATENT DOCUMENTS

| | | |
|---|---|---|
| CN | 1280241 A | 1/2001 |
| CN | 102086795 A | 6/2011 |

(Continued)

OTHER PUBLICATIONS

German Search Report, dated Jan. 13, 2012, with partial English translation.

(Continued)

*Primary Examiner* — Edgardo San Martin
(74) *Attorney, Agent, or Firm* — RatnerPrestia

(57) ABSTRACT

A control device of a motor vehicle having a noise transmission system and an exhaust system, wherein the noise transmission system has, for manipulating an interior noise of the motor vehicle, at least one intake noise transmission device which can be coupled via a first tubular connecting element to an air intake pipe leading to an internal combustion engine, the first tubular connecting element being assigned a switchable shut-off device, and which can be coupled via a second tubular connecting element to a vehicle interior, wherein the exhaust system has at least one switchable shut-off device for manipulating an exterior noise of the motor vehicle, and wherein the control device manipulates the operation of the noise transmission system and of the exhaust system jointly as a function of an actuation of a common operating element by the driver.

9 Claims, 5 Drawing Sheets

(56) References Cited

U.S. PATENT DOCUMENTS

| | | | | |
|---|---|---|---|---|
| 7,448,353 | B2 * | 11/2008 | Shinada et al. | 123/184.57 |
| 7,464,788 | B2 * | 12/2008 | Alex et al. | 181/250 |
| 7,621,370 | B2 * | 11/2009 | Abe et al. | 181/204 |
| 7,703,574 | B2 * | 4/2010 | Kruger et al. | 181/254 |
| 7,975,802 | B2 * | 7/2011 | Yokoya et al. | 181/160 |
| 8,009,839 | B2 * | 8/2011 | Hagen | 381/86 |
| 8,011,469 | B2 * | 9/2011 | Olson | 181/204 |
| 8,127,888 | B1 * | 3/2012 | Mah | 181/271 |
| 8,186,323 | B2 * | 5/2012 | Akimoto et al. | 123/184.53 |
| 8,322,486 | B2 * | 12/2012 | Ohta et al. | 181/229 |
| 8,381,871 | B1 * | 2/2013 | Hellie et al. | 181/250 |
| 8,418,445 | B2 * | 4/2013 | Laube et al. | 60/299 |
| 2004/0094112 | A1 * | 5/2004 | Hoffmann et al. | 123/184.57 |
| 2005/0121255 | A1 * | 6/2005 | Hofmann et al. | 181/250 |
| 2005/0133300 | A1 * | 6/2005 | Hofmann et al. | 181/250 |
| 2006/0060419 | A1 * | 3/2006 | Alex et al. | 181/250 |
| 2007/0044747 | A1 * | 3/2007 | Sawatari et al. | 123/184.21 |
| 2007/0131189 | A1 * | 6/2007 | Shinada et al. | 123/184.57 |
| 2007/0182525 | A1 * | 8/2007 | McCarthy et al. | 340/425.5 |
| 2009/0000587 | A1 * | 1/2009 | Seko et al. | 123/184.57 |
| 2009/0319160 | A1 * | 12/2009 | Callahan et al. | 701/111 |
| 2011/0000186 | A1 * | 1/2011 | Laube et al. | 60/272 |
| 2011/0126531 | A1 | 6/2011 | Kye et al. | |
| 2013/0008402 | A1 * | 1/2013 | Muller et al. | 123/184.57 |
| 2013/0008738 | A1 * | 1/2013 | Muller et al. | 181/229 |

FOREIGN PATENT DOCUMENTS

| | | | |
|---|---|---|---|
| DE | 10042012 | A1 | 5/2001 |
| DE | 10222507 | A1 | 5/2003 |
| DE | 10310487 | A1 | 9/2004 |
| DE | 102009032214 | A1 | 1/2011 |
| EP | 2 199 551 | A1 | 6/2010 |

OTHER PUBLICATIONS

Chinese Search Report, dated Apr. 24, 2014, corresponding to Chinese counterpart patent application No. 201210234940.8.

* cited by examiner

CONTROL DEVICE OF A MOTOR VEHICLE

CROSS-REFERENCE TO RELATED APPLICATIONS

This U.S. patent application claims priority to German Patent application DE 10 2011 051 690.5, filed Jul. 8, 2011, which is incorporated by reference herein in its entirety.

FIELD OF THE INVENTION

The invention relates to a control device of a motor vehicle which has a noise transmission system and an exhaust system.

BACKGROUND OF THE INVENTION

Known from DE 103 10 487 A1, which is incorporated by reference, is a noise transmission system of a motor vehicle for setting, in an interior of the motor vehicle, a defined noise level to be transmitted from the internal combustion engine into the interior of the motor vehicle. According to DE 103 10 487 A1, the noise transmission system comprises an intake noise transmission device which can be coupled via a first tubular connecting element to an intake air pipe leading to an internal combustion engine, and which can be coupled via a second tubular connecting element to a vehicle interior of the motor vehicle.

It is furthermore known from DE 103 10 487 A1 to assign a switchable shut-off device to the first tubular connecting element via which the intake noise transmission device can be coupled to the air intake pipe leading to the internal combustion engine. Here, according to said prior art, when the shut-off device is closed, the intake noise transmission device is substantially decoupled from the intake noise of the internal combustion engine, whereas when the shut-off device is open, the intake noise transmission device is coupled to the intake noise of the internal combustion engine.

Even though it is already possible with the noise transmission system known from the prior art to set an interior noise level in the interior of the motor vehicle, there is a demand for a control device of a motor vehicle by means of which a novel manipulation of the motor vehicle noise level, specifically of an interior noise level and of an exterior noise level, is possible automatically.

SUMMARY OF THE INVENTION

Taking this as a starting point, the present invention provides a novel control device of a motor vehicle.

The control device according to aspects of the invention serves for the automatic actuation of a noise transmission system and of an exhaust system of a motor vehicle, wherein the noise transmission system has, for manipulating an interior noise of the motor vehicle, at least one intake noise transmission device which can be coupled via a first tubular connecting element to an air intake pipe leading to an internal combustion engine, the first tubular connecting element being assigned a switchable shut-off device, and which can be coupled via a second tubular connecting element to a vehicle interior, wherein the exhaust system has at least one switchable shut-off device for manipulating an exterior noise of the motor vehicle, and wherein the control device automatically manipulates the operation of the noise transmission system and of the exhaust system jointly as a function of an actuation of a common operating element by the driver. The control device automatically permits a novel manipulation of the interior noise level and of the exterior noise level of a motor vehicle.

It may be preferable for characteristic maps on the basis of which the control device automatically actuates, that is to say opens or closes, the shut-off devices of the noise transmission system and exhaust system to be stored in the control device. Such characteristic-map-based actuation of the shut-off devices is particularly simple and may be therefore preferable.

In one advantageous refinement, characteristic maps for manipulating the shut-off devices of the intake noise transmission device and of a resonator device, which may be preferably provided and which interacts with the intake noise transmission device, of the noise transmission system are a function of a body type of the motor vehicle. This permits an automatic actuation of the shut-off devices of the noise transmission system and therefore of the interior noise level in a manner suited to the respective body type of the motor vehicle. Characteristic maps for manipulating the or each shut-off device of the exhaust system and therefore for manipulating the exterior noise level are, by contrast, preferably independent of the body type of the motor vehicle.

BRIEF DESCRIPTION OF THE DRAWING FIGURES

Preferred refinements of the invention will emerge from the following description. Exemplary embodiments of the invention will be explained in more detail, without the invention being restricted thereto, on the basis of the drawing, in which.

DETAILED DESCRIPTION OF THE DRAWING FIGURES

Figure 1:
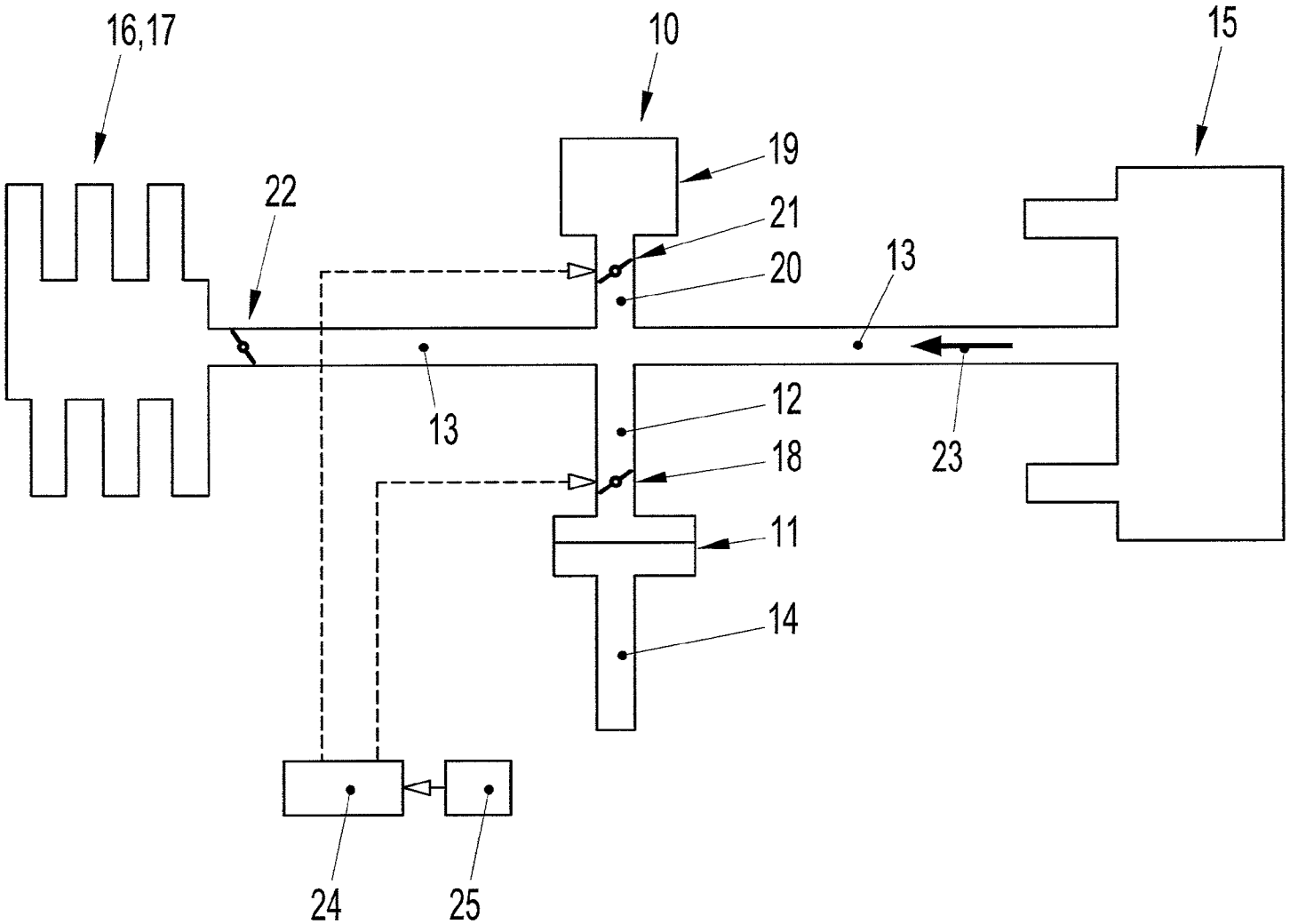
FIG. 1 shows a schematic illustration of a noise transmission system of a motor vehicle together with an internal combustion engine and an air filter.
Figure 2:
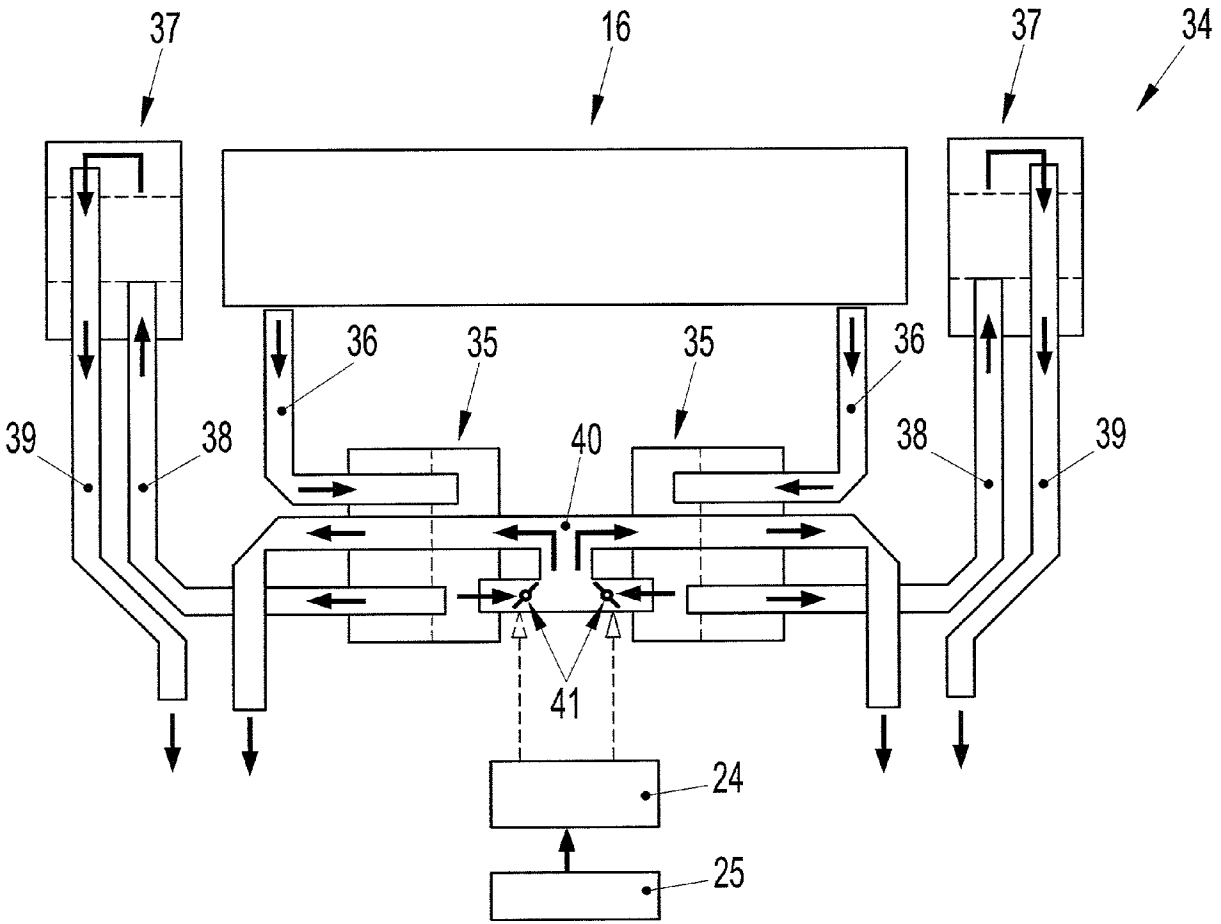
FIG. 2 shows a schematic illustration of an exhaust system of the motor vehicle together with the internal combustion engine.

The present invention relates to a motor vehicle having a noise transmission system 10 (see FIG. 1) and an exhaust system 34 (see FIG. 2).

By means of the noise transmission system 10, it is possible in an interior of the motor vehicle to manipulate defined interior noise levels in order to provide an occupant with different noises dependent on an internal combustion engine of the motor vehicle. An exterior noise level of the motor vehicle can be manipulated by means of the exhaust system 34.

The noise transmission system 10 has an intake noise transmission device 11 which can be coupled via a first tubular connecting element 12 to an air intake pipe 13 and via a second tubular connecting element 14 to an interior (not shown) of the motor vehicle.

The air intake pipe 13 leads from an air filter device 15 to an internal combustion engine 16, specifically to an air intake system 17 of the internal combustion engine 16. The intake noise transmission device 11 is also referred to as a sound symposer and may be constructed as is known from DE 103 10 487 A1.

As per FIG. 1, the first tubular connecting element 12, via which the intake noise transmission device 11 can be coupled to the air intake pipe 13, is assigned a first switchable shut-off device 18.

When the first shut-off device 18 is open, the intake noise transmission device 11 is coupled to intake noises of the internal combustion engine, specifically to intake noises in the air intake pipe 13, whereas when the first shut-off device 18 is closed, said intake noise transmission device 11 is substantially decoupled from said intake noises.

The noise transmission system 10 preferably has, in addition to the intake noise transmission device 11, a resonator device 19 which interacts with the intake noise transmission device 11, wherein the resonator device 19 is preferably a Helmholtz resonator. The resonator device 19 is tuned to a defined frequency, also referred to as the tuning frequency. The resonator device 19 may for example be tuned to a frequency of 240 Hz, in particular if said frequency is subject to intense excitation in a defined rotational speed range of the internal combustion engine by an order of vibration thereof, for example the third order of engine vibration.

The resonator device 19 of the noise transmission system 10 can be coupled via a third tubular connecting element 20 to the air intake pipe 13 which leads to the internal combustion engine 16, in the same way as the intake noise transmission device 11 can be coupled via the first tubular connecting element 12. Here, for the functioning of the resonator device 19, the third tubular connecting element 20 is coordinated in terms of its length and diameter with the size of the volume of the resonator device 19.

The third tubular connecting element 20, via which the resonator device 19 can be coupled to the intake pipe 13, is assigned a second shut-off device 21 which, like the first shut-off device 18 assigned to the first tubular connecting element 12, is designed to be switchable. When the second switchable shut-off device 21 is open, the resonator device 19 is coupled to intake noises in the intake pipe 13, whereas when the second shut-off device 21 is closed, the resonator device 19 is substantially decoupled from intake noises in the intake pipe 13.

By means of the intake noise transmission device 11, an interior noise level in the interior of the motor vehicle can be manipulated directly. By means of the resonator device 19 which is preferably designed as a Helmholtz resonator, the interior noise level in the interior of the motor vehicle can be manipulated indirectly via the intake noise transmission device 11.

The two switchable shut-off devices 18 and 21 of the noise transmission system 10, specifically the first shut-off device 18 which interacts with the intake noise transmission device 11 and the second shut-off device 21 which interacts with the resonator device 19, can be actuated and thus switched such that, in a first switching position combination, the first switchable shut-off device 18 is closed and the second switchable shut-off device 21 is open. Accordingly, in the first switching position combination, the intake noise transmission device 11 is, with the shut-off device 18 closed, substantially decoupled from the intake noise in the intake pipe 13, whereas the resonator device 19 is, with the second shut-off device 21 open, coupled to the intake noise in the intake pipe 13.

In a second switching position combination of the two switchable shut-off devices 18, 21, both the first switchable shut-off device 18 and also the second switchable shut-off device 21 are closed, wherein then both the intake noise transmission device 11 and also the resonator device 19 are substantially decoupled from the intake noise in the intake pipe 13.

In a third switching position combination of the two switchable shut-off devices 18, 21, both switchable shut-off devices 18 and 21 are open, such that then both the intake noise transmission device 11 and also the resonator device 19 are coupled to intake noises in the intake pipe 13.

In a fourth switching position combination in which the first switchable shut-off device 18 is open and the second switchable shut-off device 21 is closed, the intake noise transmission device 11 is coupled to the intake noise in the intake pipe 13, whereas the resonator device 19 is substantially decoupled from said intake noise in the intake pipe 13.

The above four switching position combinations of the two switchable shut-off devices 18 and 21 are summarized in the following table:

| Switching position combination | Switchable shut-off device 18 of the intake noise transmission device 11 | | Switchable shut-off device 21 of the resonator device 19 | |
|---|---|---|---|---|
| | OPEN | CLOSED | OPEN | CLOSED |
| 1 | X | | | X |
| 2 | | X | | X |
| 3 | X | | X | |
| 4 | | X | X | |

The above first switching position combination, in which the first shut-off device 18 is closed and the second shut-off device 21 is open, serves to provide a first, relatively quiet interior noise level in the interior (not shown) of the motor vehicle, wherein said first interior noise level can be referred to as a comfort noise level. The above second switching position combination, in which both shut-off devices 18, 21 are closed, serves to provide a second interior noise level which is higher than the first interior noise level, wherein the second interior noise level can be referred to as an intermediate noise level.

The above third switching position combination, in which both shut-off elements 18, 21 are open, serves to provide a third interior noise level which is higher than the second interior noise level and thus also higher than the first interior noise level, wherein said third interior noise level can also be referred to as a sport noise level.

The above fourth switching position combination, in which the first shut-off device 18 is open and the second shut-off device 21 is closed, serves to provide a fourth interior noise level which is higher than the third interior noise level and thus also higher than the second and first interior noise levels, wherein said fourth interior noise level can also be referred to as a racing interior noise level. The two switchable shut-off devices 18, 21 of the noise transmission system 10 are preferably designed as flaps which can be moved independently of one another between an open flap position and a closed flap position.

As already discussed above, the first tubular connecting element 12, via which the intake noise transmission device 11 can be coupled to the air intake pipe 13, and the third tubular connecting element 20, via which the resonator device 19 can be coupled to the intake pipe 13, engage in each case on the air intake pipe 13 which leads from the air filter device 15 to the internal combustion engine 16, specifically to the air intake system 17 of the internal combustion engine 16, said engagement taking place specifically downstream of the air filter device 15 and upstream of a throttle flap 22 assigned to the air intake pipe 13. As can be seen from FIG. 1, it is provided here that the first tubular connecting element 12 and the third tubular connecting element 20 engage on the air intake pipe 13 at the same axial position in relation to a throughflow direction 23 of the air intake pipe 13.

The axial position at which the first tubular connecting element 12 and the third tubular connecting element 20 engage on the air intake pipe 13 is characterized by a relatively high, preferably maximum, pressure oscillation amplitude in relation to the tuning frequency of the resonator device 19.

The first tubular connecting element 12 and the third tubular connecting element 20 engage on the air intake pipe 13 at said axial position of the air intake pipe 13 with a circumferential offset which amounts to in particular between 90° and 270°.

The noise transmission system 10 of FIG. 1 accordingly comprises an intake noise transmission device 11 and a resonator device 19. The intake noise transmission device 11 can be coupled via a first tubular connecting element 12 to the air intake pipe 13, whereas the resonator device 19 can be coupled via a third tubular connecting element 20 to the air intake pipe 13. The intake noise transmission device 11 can be coupled via a second tubular connecting element 14 to the interior of the motor vehicle. Both the intake noise transmission device 11 and also the resonator device 19 are assigned in each case one switchable shut-off device 18 and 21, wherein the shut-off device 18 assigned to the intake noise transmission device 11 is assigned to the first tubular connecting element 12, and wherein the shut-off device 21 assigned to the resonator device 19 is assigned to the third tubular connecting element 20. A different interior noise level can be set in the vehicle interior of the motor vehicle as a function of the switching position of the shut-off devices 18, 21.

The exhaust system 34 of the motor vehicle (see FIG. 2) comprises at least one front silencer 35 to which exhaust gas emerging from the internal combustion engine 16 can be supplied via in each case one exhaust pipe 36. In each case one rear silencer 37 interacts with the or each front silencer 35, wherein the respective rear silencer 37 is coupled to the respective front silencer 35 via an exhaust pipe 38 and issues into the environment via an exhaust pipe 39.

Via an exhaust pipe 40 which branches off from the or each front silencer 35 and to which shut-off devices 41 are assigned, exhaust gas can be discharged, bypassing the or each rear silencer 37, directly into the environment. It is preferably the case, as per FIG. 2, that a separate, switchable shut-off device 41 interacts with each front silencer 35. One common switchable shut-off device 41 may also be provided for both front silencers 35.

When the or each shut-off device 41 is closed, all of the exhaust gas must flow through the or each rear silencer 37, whereby a relatively low exterior noise level of the motor vehicle can be set. When the or each shut-off device 41 is open, a part of the exhaust gas can flow so as to bypass the respective rear silencer 37, as a result of which a relatively high, sporty exterior noise level of the motor vehicle can be set.

For the automatic actuation of the shut-off devices 18, 21, 41, the motor vehicle comprises a control device 24. The control device 24 automatically actuates the first switchable shut-off device 18 and/or the second switchable shut-off device 21 of the noise transmission system 10 in order to set the interior noise level, and automatically actuates the or each shut-off device 41 of the exhaust system 34 in order to set the exterior noise level.

In the control device 24 there are preferably stored characteristic maps, on the basis of which the control device 24 automatically actuates, that is to say opens or closes, the first switchable shut-off device 18 and/or the second switchable shut-off device 21 of the noise transmission system 10. Likewise stored in the control device 24 are characteristic maps, on the basis of which the control device 24 automatically actuates, that is to say opens or closes, the or each shut-off device 41 of the exhaust system 34. Said characteristic maps are at least a function of a rotational speed of the internal combustion engine and/or a function of a load of the internal combustion engine. As a function of an actuation by the driver of a common operating element 25 installed in the vehicle interior, the control device 24 determines characteristic maps for the automatic, joint actuation of the shut-off devices 18 and/or 21 and 41 of the noise transmission system 10 and of the exhaust system 34.

The characteristic maps for manipulating the shut-off devices 18, 21 of the intake noise transmission device 11 and of the resonator device 19 are preferably also a function of a body type of the motor vehicle. The characteristic maps for manipulating the or each shut-off device 41 of the exhaust system 34 are, by contrast, independent of a body type of the motor vehicle.

Figure 3:
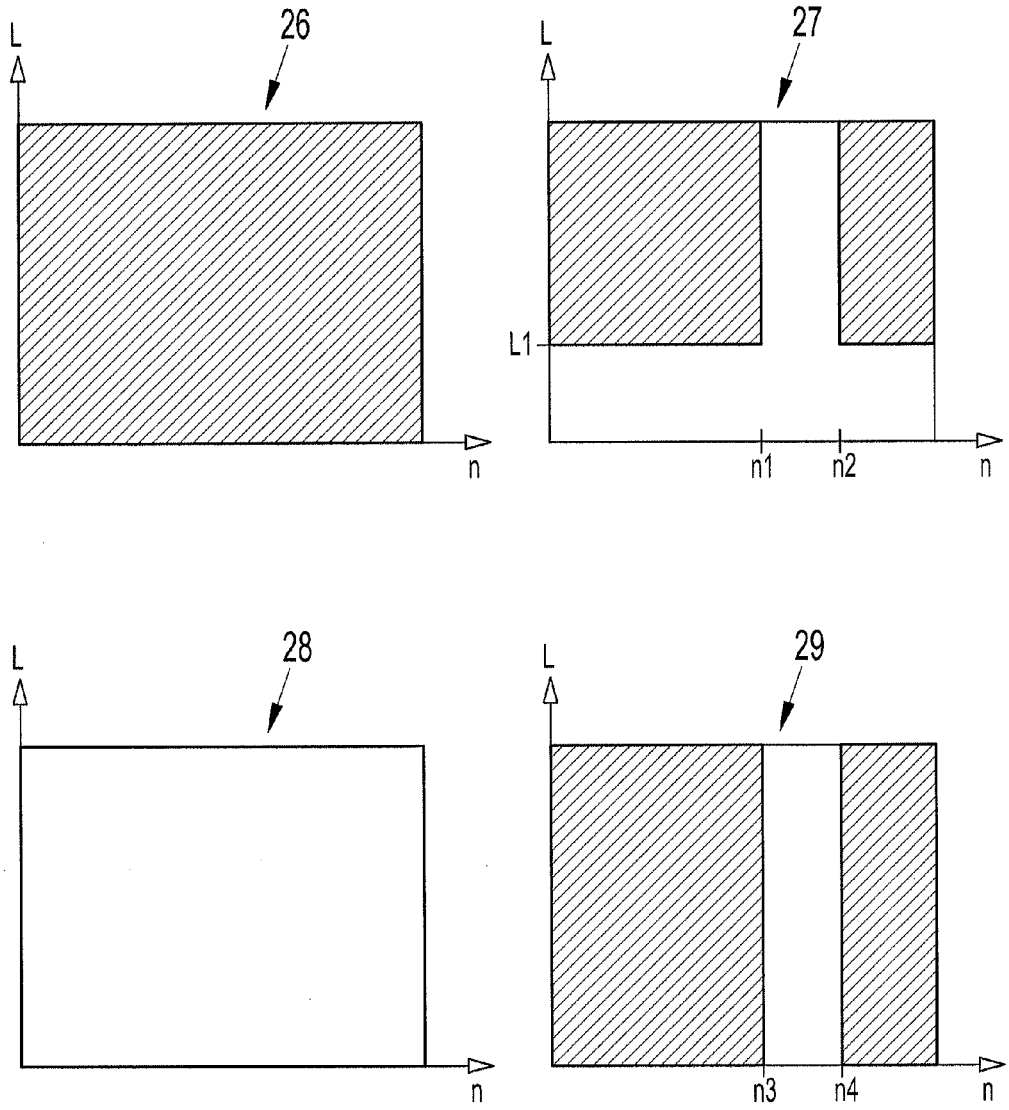
FIG. 3 shows characteristic maps for the actuation of the shut-off devices of the noise transmission system in the case of a coupe-type motor vehicle.

FIG. 3 shows a total of four characteristic maps 26, 27, 28 and 29 for the automatic actuation of the first switchable shut-off device 18 and of the second switchable shut-off device 21 of the noise transmission system 10, such as are preferably used in a coupe-type or sedan-type motor vehicle. Each of the characteristic maps is a function of the rotational speed n of the internal combustion engine and the load L of the internal combustion engine.

In a first, preferably non-actuated state of actuation of the operating element 25 which can be actuated by the driver, a first characteristic map 26 serves for the automatic actuation of the first switchable shut-off device 18 of the noise transmission system 10, and a second characteristic map 27 serves for the automatic actuation of the second switchable shut-off device 21 of the noise transmission system 10. The first characteristic map 26 for the automatic actuation of the first switchable shut-off device 18 of the noise transmission system 10 permanently closes the first shut-off device 18. The second characteristic map 27 for the automatic actuation of the second switchable shut-off device 21 of the noise transmission system 10 automatically opens or closes the second shut-off device 21 as a function of the rotational speed n of the internal combustion engine, specifically such that, when the internal combustion engine is at a relatively low load L lower than a threshold value L1, the second characteristic map 27 opens the second shut-off device 21 over the entire rotational speed range of the internal combustion engine. By contrast, when the internal combustion engine is at a relatively high load higher than the threshold value L1, the second characteristic map 27 actuates the second shut-off device 21 such that the second shut-off device 21 is closed when the rotational speed of the internal combustion engine is lower than a lower threshold value n1 or higher than an upper threshold value n2, and the second shut-off device 21 is open when the rotational speed of the internal combustion engine is higher than the lower threshold value n1 and lower than the upper threshold value n2.

Figure 4:
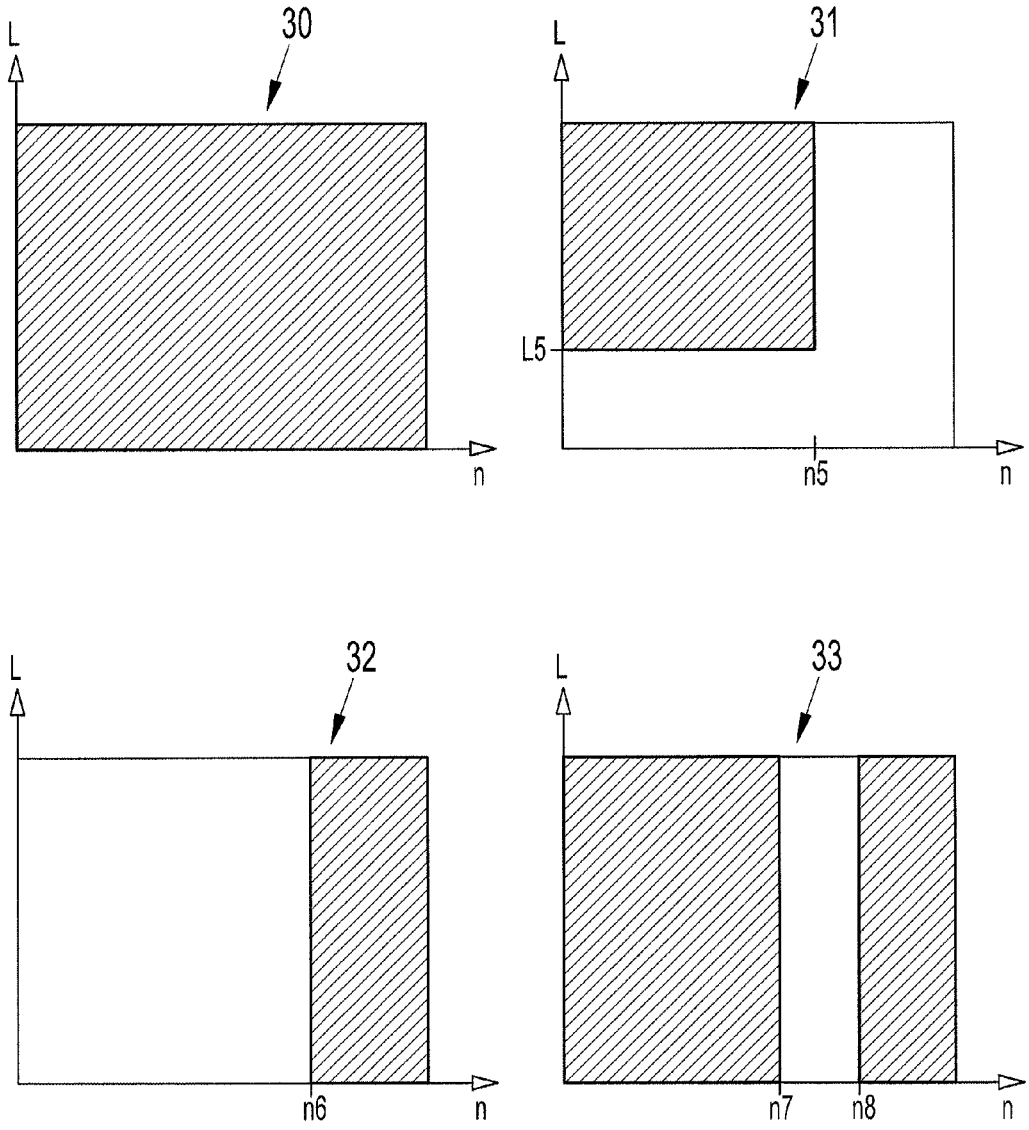
FIG. 4 shows characteristic maps for the actuation of the shut-off devices of the noise transmission system in the case of a cabriolet-type motor vehicle.

Characteristic map areas in which the respective shut-off device of the noise transmission system 10 is closed are in each case hatched in FIGS. 3 and 4, whereas characteristic map areas in which the respective shut-off device of the noise transmission system 10 is open are not hatched in FIGS. 3 and 4.

In a second, preferably actuated state of actuation of the operating element 25 which can be actuated by the driver, a third characteristic map 28 serves for the automatic actuation of the first switchable shut-off device 18 of the noise transmission system 10, and a fourth characteristic map 29 serves for the automatic actuation of the second switchable shut-off device 21 of the noise transmission system 10. The third characteristic map 28 for the automatic actuation of the first switchable shut-off device 18 of the noise transmission system 10 permanently opens the first shut-off device 18. The fourth characteristic map 29 for the automatic actuation of the second switchable shut-off device 21 of the noise transmission system 10 automatically opens or closes the second shut-off device 21 as a function of the rotational speed n of the internal combustion engine and independently of the load L of the internal combustion engine. The fourth characteristic map 29 automatically actuates the second shut-off device 21 such that the second shut-off device 21 is closed when the rotational speed of the internal combustion engine is lower than a lower threshold value n3 or higher than an upper threshold value n4, and the second shut-off device 21 is open when the rotational speed of the internal combustion engine is higher than the lower threshold value n3 and lower than the upper threshold value n4.

The threshold value n3 may correspond to the threshold value n1 and the threshold value n4 may correspond to the threshold value n2. Said threshold values may however also differ.

FIG. 4 shows a total of four characteristic maps 30, 31, 32 and 33 for the automatic actuation of the first switchable shut-off device 18 of the noise transmission system 10 and of the second switchable shut-off device 21 of the noise transmission system 10, such as are preferably used in a cabriolet-type motor vehicle. Each of the four characteristic maps 30, 31, 32 and 33 is again a function of the rotational speed n of the internal combustion engine 16 and also of the load L of the internal combustion engine 16.

In the case of a cabriolet-type motor vehicle, in a first, in particular non-actuated state of actuation of the operating element 25, a first characteristic map 30 for the automatic actuation of the first switchable shut-off device 18 of the noise transmission system 10 permanently closes the first shut-off device 18. In the first state of actuation of the operating element 25, a second characteristic map 31 for the automatic actuation of the second switchable shut-off device 21 of the noise transmission system 10 automatically opens or closes the second shut-off device 21 as a function of the rotational speed of the internal combustion engine. Accordingly, the characteristic maps 30, 31 are active when the operating element 25 is in the first state of actuation. When the internal combustion engine is at a relatively low load lower than a threshold value L5, the second characteristic map 31 for the automatic actuation of the second switchable shut-off device 21 of the noise transmission system 10 opens the second shut-off device 21 over the entire rotational speed range of the internal combustion engine, whereas when the internal combustion engine is at a relatively high load higher than the threshold value L5, the second characteristic map 31 actuates the second shut-off device 21 such that the second shut-off device 21 is closed when the rotational speed of the internal combustion engine is lower than a threshold value n5 and the second shut-off device 21 is open when the rotational speed of the internal combustion engine is higher than the threshold value n5.

In a second, in particular actuated state of actuation of the operating element 25, a third characteristic map 32 for the automatic actuation of the first switchable shut-off device 18 of the noise transmission system 10 and a fourth characteristic map 33 for the automatic actuation of the second switchable shut-off device 21 of the noise transmission system 10 are activated and the characteristic maps 30, 31 are deactivated, wherein the third characteristic map 32 automatically opens or closes the first shut-off device 18, and the fourth characteristic map 33 automatically opens or closes the second shut-off device 21, in each case individually as a function of the rotational speed of the internal combustion engine. The third characteristic map 32 for the automatic actuation of the first switchable shut-off device 18 of the noise transmission system 10 actuates the first shut-off device 18, independently of the load of the internal combustion engine, such that the first shut-off device 18 is open when the rotational speed of the internal combustion engine is lower than a threshold value n6 and the first shut-off device 18 is closed when the rotational speed of the internal combustion engine is higher than the threshold value n6.

The fourth characteristic map 33 for the automatic actuation of the second switchable shut-off device 21 of the noise transmission system 10 automatically actuates the second shut-off device 21, independently of the load of the internal combustion engine, such that the second shut-off device 21 is closed when the rotational speed of the internal combustion engine is lower than a lower threshold value n7 or higher than an upper threshold value n8 and the second shut-off device 21 is open when the rotational speed of the internal combustion engine is higher than the lower threshold value n7 and lower than the upper threshold value n8.

The threshold value n5 may correspond to the threshold value n7 and the threshold value n6 may correspond to the threshold value n8. Said threshold values may however also differ.

It is also possible, in the case of a body type with a sliding roof or panorama roof, for different characteristic maps to be stored in the control device 24 for driving with the sliding roof or panorama roof closed and for driving with the sliding roof or panorama roof open, said characteristic maps being automatically activated by the control device 24 as a function of the state of the sliding roof or panorama roof. The characteristic maps for the closed sliding roof or panorama roof may correspond to the characteristic maps for the coupe type, and the characteristic maps for the open sliding roof or panorama roof may correspond to the characteristic maps for the cabriolet type.

Figure 5:
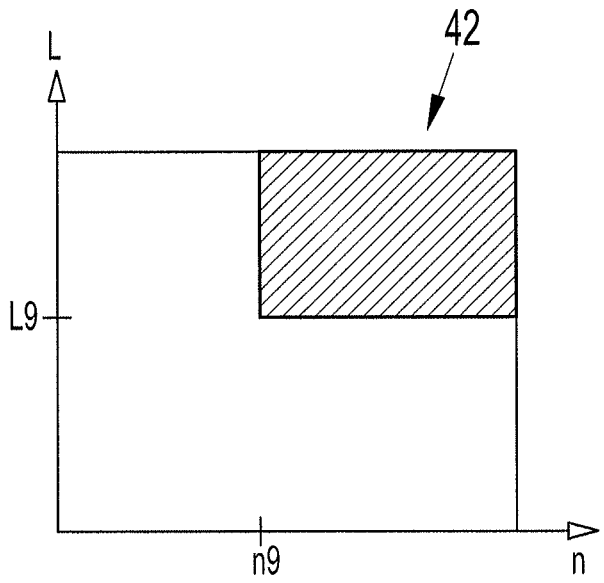
FIG. 5 shows characteristic maps for the actuation of the shut-off devices of the exhaust system of the motor vehicle.
Figure 5:
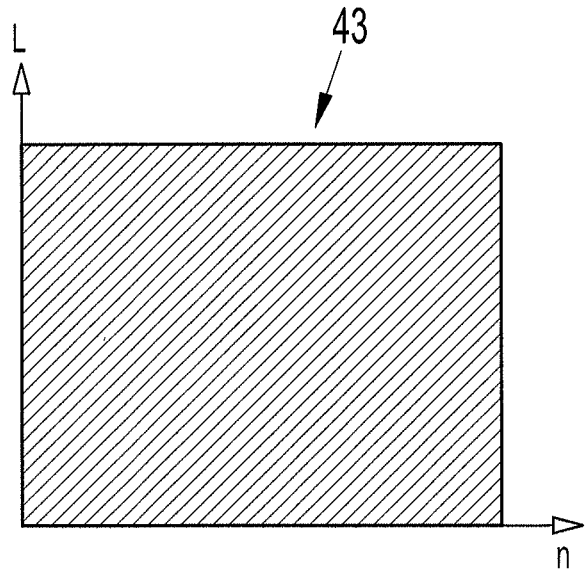

As already stated, the control device 24 manipulates firstly the operation of the noise transmission system 10, and secondly the operation of the exhaust system 34, as a function of the actuation of the common operating element 25 by the driver. FIG. 5 shows two characteristic maps 42 and 43, on the basis of which the control device 24 manipulates the operation of the exhaust system 34, specifically the or each shut-off device 41 of the exhaust system 34. In the first, in particular non-actuated state of actuation of the operating element 25, a first characteristic map 42 for the automatic actuation of the switchable shut-off devices 41 of the exhaust system 34 opens and closes the shut-off devices 41 as a function of the rotational speed n and load L of the internal combustion engine such that the shut-off devices 41 are open when the rotational speed n is higher than a threshold value n9 and the load L is higher than a threshold value L9. By contrast, the shut-off devices 41 are closed when the rotational speed n is lower than the threshold value n9 and/or the load L is lower than the threshold value L9.

In the second, in particular actuated state of actuation of the operating element 25, a second characteristic map 43 for the automatic actuation of the switchable shut-off devices 41 of the exhaust system 34 permanently opens the shut-off devices 41.

Characteristic map areas in which the or each shut-off device 41 of the exhaust system 34 is open are in each case hatched in FIG. 5, whereas characteristic map areas in which the or each shut-off device 41 of the exhaust system 34 is closed are not hatched in FIG. 5.

When the operating element 25 is not actuated, the shut-off devices 41 of the exhaust system 34 are opened only when the internal combustion engine is at a relatively high rotational speed n higher than the threshold value n9 and when the internal combustion engine is simultaneously at a relatively high load L higher than the threshold value L9, such that a relatively high, sporty exterior noise level is provided, with relatively high engine performance simultaneously being ensured, only when the internal combustion engine is at relatively high rotational speeds and loads. By contrast, when the internal combustion engine is at relatively low rotational speeds and/or relatively low loads, when the operating element 25 is not actuated, the shut-off devices 41 of the exhaust system 34 are closed, whereby a relatively low exterior noise level is provided. Furthermore, at the same time, when the operating element 25 is not actuated, a relatively low interior noise level is provided through corresponding actuation of the shut-off devices 18 and 21. For this purpose, when the operating element 25 is in the non-actuated state of actuation, a characteristic map 26 or 30 permanently closes the shut-off device 18 of the intake noise transmission device 11, wherein a further characteristic map 27 or 31 permanently opens the shut-off device 21 of the resonator device 19 when the internal combustion engine is at a relatively low load lower than the threshold value L1 or L5, and opens and closes the shut-off device 21 of the resonator device 19 as a function of rotational speed when the internal combustion engine is at a relatively high load higher than the threshold value L1 or L5. Here, the or each shut-off device 41 of the exhaust system 34 is permanently closed by means of characteristic map 42 when the internal combustion engine is at relatively low load, wherein the characteristic map 42 opens and closes the or each shut-off device 41 of the exhaust system 34 as a function of rotational speed when the internal combustion engine is at relatively high load. Each of the above-described noise levels, loads, rotational speeds, threshold values and any other values mentioned herein are predetermined.

By contrast, when the operating element 25 is actuated, the shut-off devices 41 of the exhaust system 34 are permanently open, such that a relatively high, sporty exterior noise level is permanently provided. Furthermore, at the same time, when the operating element 25 is actuated, a relatively high interior noise level is provided through corresponding actuation of the shut-off devices 18 and 21. For this purpose, when the operating element 25 is in the second state of actuation, a characteristic map 28 permanently opens the shut-off device 18 of the intake noise transmission device 11, or a characteristic map 32 opens and closes the shut-off device 18 of the intake noise transmission device 11 as a function of rotational speed, wherein a further characteristic map 29 or 33 opens and closes the shut-off device 21 of the resonator device 19 as a function of rotational speed.

LIST OF REFERENCE NUMERALS

10 Noise transmission system
11 Intake noise transmission device
12 Connecting element
13 Intake pipe
14 Connecting element
15 Air filter device
16 Internal combustion engine
17 Intake system
18 Shut-off device
19 Resonator device
20 Connecting element
21 Shut-off device
22 Throttle flap
23 Flow direction
24 Control device
25 Actuating element
26 Characteristic map
27 Characteristic map
28 Characteristic map
29 Characteristic map
30 Characteristic map
31 Characteristic map
32 Characteristic map
33 Characteristic map
34 Exhaust system
35 Front silencer
36 Exhaust pipe
37 Rear silencer
38 Exhaust pipe
39 Exhaust pipe
40 Exhaust pipe
41 Shut-off device
42 Characteristic map
43 Characteristic map

What is claimed:

1. A control device of a motor vehicle which has a noise transmission system and an exhaust system, wherein the noise transmission system has, for manipulating an interior noise of the motor vehicle, at least one intake noise transmission device which is configured to be coupled via a first tubular connecting element to an air intake pipe leading to an internal combustion engine, the first tubular connecting element being assigned a switchable shut-off device, and which is configured to be coupled via a second tubular connecting element to a vehicle interior, wherein the exhaust system has at least one switchable shut-off device for manipulating an exterior noise of the motor vehicle, and wherein the control device manipulates the operation of the noise transmission system and of the exhaust system jointly as a function of an actuation of a common operating element by a driver of the motor vehicle, wherein in a first state of actuation of the operating element, said control device determines characteristic maps for the operation of the shut-off devices of the noise transmission system and of the exhaust system so as to yield a relatively low interior noise level and relatively low exterior noise level, and wherein in a second state of actuation of the operating element, said control device determines characteristic maps for the operation of the shut-off devices of the noise transmission system and of the exhaust system so as to yield a relatively high interior noise level and relatively high exterior noise level, wherein the noise transmission system has a resonator device which interacts with the intake noise transmission device and which is configured to be coupled via a third tubular connecting element to the air intake pipe which leads to the internal combustion engine, the third tubular connecting element being assigned a switchable shut-off device, wherein the control device automatically actuates the shut-off devices of the intake noise transmission device, of the resonator device and of the exhaust system on the basis of the characteristic maps.

2. The control device as claimed in claim 1, wherein, in the first state of actuation of the operating element, one characteristic map permanently closes the shut-off device of the intake noise transmission device, in that a further characteristic map permanently opens the shut-off device of the resonator device when the internal combustion engine is at relatively low load and opens and closes the shut-off device of the resonator device as a function of rotational speed when the internal combustion engine is at relatively high load, and in that a further characteristic map permanently closes the or each shut-off device of the exhaust system when the internal combustion engine is at relatively low load and opens and closes the or each shut-off device of the exhaust system as a function of rotational speed when the internal combustion engine is at relatively high load.

3. The control device as claimed in claim 1, wherein, in the second state of actuation of the operating element, one characteristic map permanently opens the shut-off device of the intake noise transmission device or opens and closes the shut-off device of the intake noise transmission device as a function of rotational speed, in that a further characteristic map opens and closes the shut-off device of the resonator device as a function of rotational speed, and in that a further characteristic map permanently opens the or each shut-off device of the exhaust system.

4. The control device as claimed in claim 1, wherein the characteristic maps are a function of a rotational speed of the internal combustion engine and/or a function of a load of the internal combustion engine.

5. The control device as claimed in claim 1, wherein the characteristic maps for manipulating the shut-off devices of the intake noise transmission device and resonator device are a function of a body type of the motor vehicle.

6. The control device as claimed in claim 1, wherein the characteristic maps for manipulating the or each shut-off device of the exhaust system are independent of a body type of the motor vehicle.

7. The control device as claimed in claim 1, wherein said control device automatically determines, as a function of the actuation of the operating element by the driver, the characteristic maps for the automatic operation of the shut-off device of the intake noise transmission device, of the shut-off device of the resonator device, and of the or each shut-off device of the exhaust system.

8. The control device as claimed in claim 1, wherein the characteristic maps on the basis of which the control device automatically actuates the shut-off devices of the noise transmission system and exhaust system are stored in the control device.

9. A control device of a motor vehicle which has a noise transmission system and an exhaust system, wherein the noise transmission system has, for manipulating an interior noise of the motor vehicle, at least one intake noise transmission device which is configured to be coupled via a first tubular connecting element to an air intake pipe leading to an internal combustion engine, the first tubular connecting element being assigned a switchable shut-off device, and which is configured to be coupled via a second tubular connecting element to a vehicle interior, wherein the exhaust system has at least one switchable shut-off device for manipulating an exterior noise of the motor vehicle, wherein the control device manipulates the operation of the noise transmission system and of the exhaust system jointly as a function of an actuation of a common operating element by a driver of the motor vehicle, and wherein the noise transmission system has a resonator device which interacts with the intake noise transmission device and which is configured to be coupled via a third tubular connecting element to the air intake pipe which leads to the internal combustion engine, the third tubular connecting element being assigned a switchable shut-off device, wherein the control device automatically actuates the shut-off devices of the intake noise transmission device, of the resonator device and of the exhaust system.

* * * * *